US008662603B2

(12) United States Patent
Sekol et al.

(10) Patent No.: US 8,662,603 B2
(45) Date of Patent: Mar. 4, 2014

(54) PROTECTIVE ENCLOSURE INCLUDING A PRY RESISTANT DOOR

(75) Inventors: James W. Sekol, Rochester, NY (US); Douglas E. Shaffer, Victor, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 94 days.

(21) Appl. No.: 13/351,548

(22) Filed: Jan. 17, 2012

(65) Prior Publication Data

US 2013/0015750 A1 Jan. 17, 2013

Related U.S. Application Data

(60) Provisional application No. 61/433,346, filed on Jan. 17, 2011.

(51) Int. Cl.
*E05B 53/00* (2006.01)

(52) U.S. Cl.
USPC ..... 312/218; 312/329

(58) Field of Classification Search
USPC ..... 49/460, 462; 312/218, 109, 138.1, 312/326–329
See application file for complete search history.

(56) References Cited

U.S. PATENT DOCUMENTS

| | | | | |
|---|---|---|---|---|
| 2,740,284 | A * | 4/1956 | Gray | 70/79 |
| 4,145,978 | A * | 3/1979 | Johnson et al. | 109/59 R |
| 4,720,876 | A * | 1/1988 | Tomei et al. | 4/614 |
| 5,544,595 | A * | 8/1996 | Stephenson et al. | 109/74 |
| 5,845,433 | A | 12/1998 | Walsh | |
| 5,953,860 | A * | 9/1999 | Morgan et al. | 49/257 |
| 5,971,515 | A * | 10/1999 | Baker et al. | 312/329 |
| 6,257,154 | B1 * | 7/2001 | Kasper | 109/73 |
| 7,661,375 | B2 * | 2/2010 | McCarthy et al. | 109/74 |
| 7,800,889 | B2 * | 9/2010 | Kato et al. | 361/641 |
| 7,841,221 | B2 * | 11/2010 | Hill et al. | 70/120 |
| 8,226,130 | B2 * | 7/2012 | Alfredsson et al. | 292/137 |
| 2002/0130598 | A1 | 9/2002 | Schmidt | |
| 2009/0260552 | A1 * | 10/2009 | Dunstan | 109/70 |

FOREIGN PATENT DOCUMENTS

DE 19524130 A1 9/1997

OTHER PUBLICATIONS

Boles, Rachel, "Notification of Transmittal of the International Search Report and the Written Opinion of the International Searching Authority or Declaration," for application PCT/US2012/21529, Filed Jan. 17, 2012, mailed May 22, 2012, Rijswijk, Netherlands.

* cited by examiner

*Primary Examiner* — Hanh V Tran
(74) *Attorney, Agent, or Firm* — Woods Oviatt Gilman LLP

(57) ABSTRACT

A protective enclosure including a housing defining a door opening is provided. A first flange extends from an opening end of a door and is angled relative to a surface of said door inwardly toward an interior storage space of the enclosure. The first flange and the door surface form an obtuse angle. A second flange extends from a hinge end of the door and is angled relative to the door surface inwardly toward the interior storage space. The second flange and the door surface form an obtuse angle. A hinge pivotally mounts the door with the housing. A locking mechanism selectively locks the door to the housing. The housing includes a channel disposed along at least a portion of the door opening. At least a portion of the first and second flanges are disposed within the channel when the door is closed to resist pry attacks.

25 Claims, 4 Drawing Sheets

PROTECTIVE ENCLOSURE INCLUDING A PRY RESISTANT DOOR

CROSS-REFERENCE TO RELATED APPLICATIONS

This application claims the benefit of U.S. Patent Application No. 61/433,346, filed Jan. 17, 2011, which is hereby incorporated by reference in its entirety.

BACKGROUND OF THE INVENTION

The present invention relates to a protective enclosure including a pry resistant door. In particular, the present invention is directed to a door including angled flanges that are positioned within a corresponding channel formed in a housing when the door is in a closed position.

It is common for individuals to store money, documents, firearms and other valuables within protective enclosures, such as safes, to restrict access to these items. Due to the nature of items stored in protective enclosures, there are instances in which persons seek to gain access to the interior of the protective enclosures without permission. In most cases, these instances involve the use of physical methods to gain such access. One common method of unauthorized entry is where the door of the enclosure is pried open using a crowbar or other mechanical lever. The crowbar is first wedged between the gap formed between the door and the housing, and then a force is applied in an attempt to break the locking mechanism holding the door dosed.

These types of pry attacks have been countered by modifying the protective enclosures to include mechanized bolts that actuate outwardly from the door and into the housing in a direction that is perpendicular to the long side of the door plate, opposite the hinged side. However, the inclusion of these types of mechanized bolts increases the quantity of complex moving parts that are required to manufacture this type of enclosure and thereby has an adverse affect on the cost of production. Moreover, this type of enclosure may still be vulnerable to a pry attack in a location between the mechanized bolts.

As such, there is a need for system for a protective enclosure that effectively resists pry attacks. The present invention addresses this need as well as other needs.

BRIEF SUMMARY OF THE INVENTION

In order to overcome the above stated problems and limitations, herein is provided a protective enclosure that resists pry attacks using a combination of angled flanges extending from a door of the enclosure positioned within channels formed in the housing when the door is in a closed position. These features and other features of the present invention will be described in more detail below.

In general, the protective enclosure may include a housing including a base portion, a top portion and a sidewall extending between the base portion and the top portion. The base portion, the top portion and the sidewall define an interior storage space. The sidewall includes a first sidewall portion and a second sidewall portion, wherein the first sidewall portion is positioned adjacent to the second sidewall portion to form a door corner and is disposed at a 90 degree angle relative to the second sidewall portion. The first and second sidewall portions define a door receiving opening, and the second sidewall portion includes an external surface.

A door is configured for being selectively positioned in the door receiving opening when the door is in a closed position.

The door includes a door section and a second door section. The first door section is positioned adjacent to the second door section and is disposed at a 90 degree angle relative to the second door section. The first door section is positioned in a first plane and includes an opening end, wherein a first flange extends from the opening end and includes an opening edge. The first flange is angled relative to the first door section inwardly toward the interior storage space at about a 45 degree angle relative to the first plane so that the first door section and the first flange form an obtuse angle. The first sidewall portion and the first door section may be coplanar. The second door section is positioned in a second plane that is perpendicular to the first plane and includes a hinge end and an external surface. A second flange extends from the hinge end and includes a hinge edge that is parallel with the opening edge, the second flange being angled relative to the second door section inwardly toward the interior storage space at about a 45 degree angle relative to the second plane so that the second door section and the second flange form an obtuse angle. The second sidewall portion and the second door section may be coplanar.

A hinge pivotally mounts the second portion of the housing with the second door section. The hinge is coupled with the external surface of the second sidewall portion of the housing and the external surface of the second door section.

A locking mechanism includes a first actuating bolt and a second actuating bolt that are movably coupled to the door adjacent to the door corner along an axis that is substantially parallel to at least one of the opening edge and the hinge edge. The first and second actuating bolts may be moved to an extended position to place the door in a locked position relative to the housing when door is in the closed position, and the first and second actuating bolts may be moved to a retracted position to place the door in an unlocked position relative to the housing. At least one of the first and second sidewall portions includes a first retaining surface configured for engaging the first actuating bolt when in the extended position, and at least one of the first and second sidewall portions includes a second retaining surface configured for engaging the second actuating bolt when in the extended position. The housing may include a U-shaped channel disposed along at least a portion of the door receiving opening defined in the first portion and the second portion of the housing. At least a portion of the first and second flanges are disposed within the U-shaped channel when the door is positioned in the closed position relative to the housing to resist pry attacks on the protective enclosure.

Additional objects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
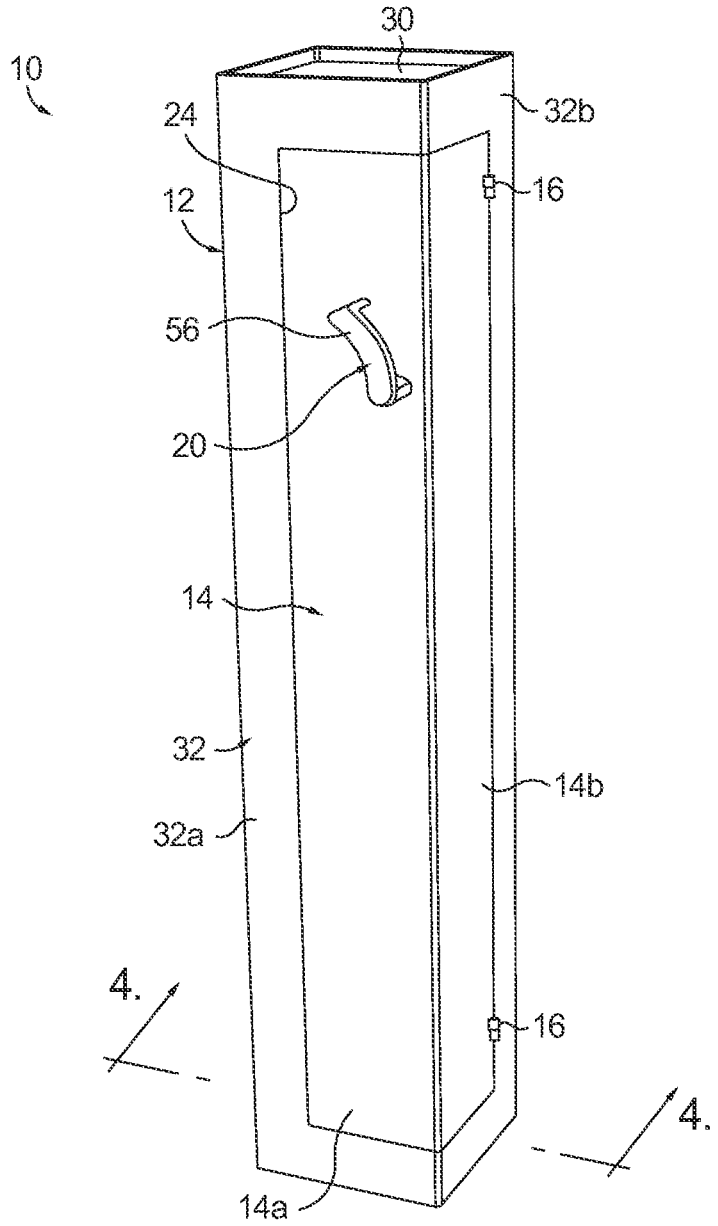
FIG. 1 is a perspective view of a protective enclosure including a door in a closed position.

Referring now to the drawings in detail, and specifically to FIGS. 1-4, reference numeral 10 generally designates a protective enclosure in accordance with the present invention. In general, protective enclosure 10 includes a housing 12, a door 14, and at least one hinge 16 pivotably mounting door 14 to housing 12. Door 14 may be selectively moved between an open position (FIGS. 2 and 3) to allow access to interior storage 18 space defined by housing 12, and a closed position (FIGS. 1 and 4) to restrict access to interior storage space 18. Protective enclosure 10 may further include a locking mechanism 20 that is mounted to door 14 and operates to selectively secure door 14 to housing 12 to restrict access to interior storage space 18. In accordance with one aspect of the present invention, housing 12 includes at least one channel 22*a*, 22*b* formed in a door receiving opening 24 that is configured for receiving inwardly angled flanges 26*a*, 26*h* extending from door 14 to effectively resist pry attacks on protective enclosure 10. This aspect of the present invention, along with other aspects of the present invention will be described in more detail below.

Figure 2:
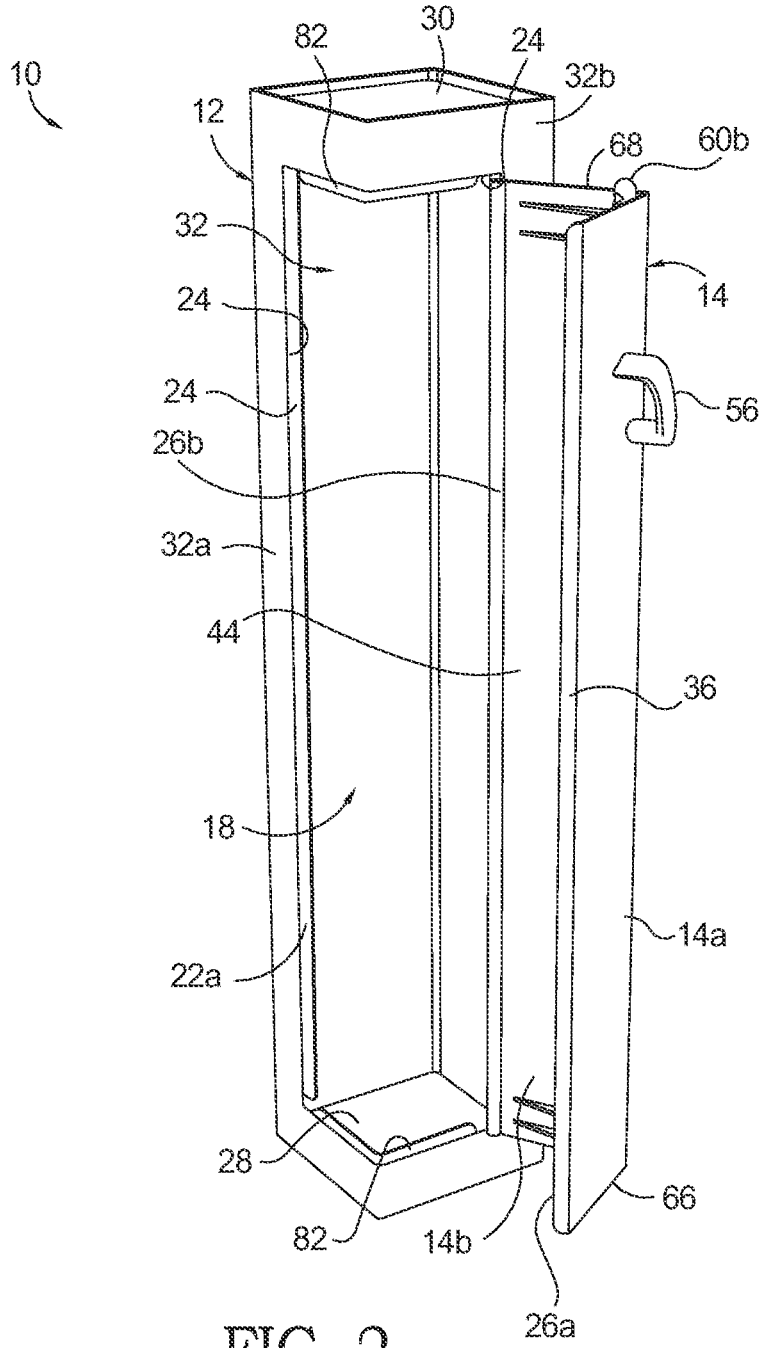
FIG. 2 is a perspective view of the protective enclosure shown in FIG. 1 in an opened position.
Figure 4:
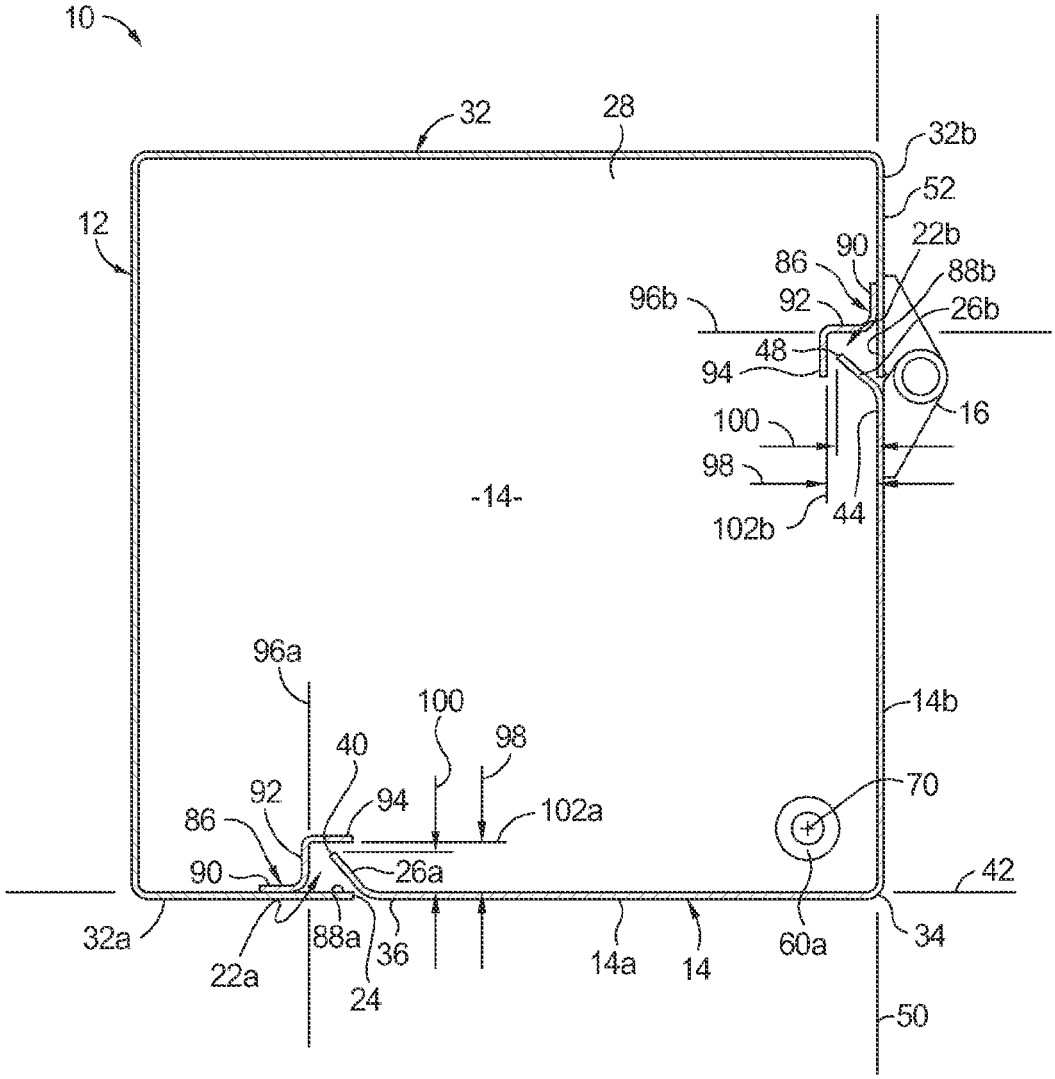
FIG. 4 is a cross sectional view taken along line 4-4 in FIG. 1.

Housing 12 includes a base portion 28, a top portion 30, and a sidewall 32 extending between base portion 28 and top portion 30. Base portion 28, top portion 30 and sidewall 32 define interior storage space 18 which may be used to store documents, firearms and other valuables. Sidewall 32 includes a first sidewall portion 32*a* positioned adjacent to a second sidewall portion 32*b*, wherein first sidewall portion 32*a* may be disposed at an angle, for example, about 90 degrees, relative to second sidewall portion 32*b*. Door receiving opening 24 is defined by both first and second sidewall portions 32*a*, 32*b* and is configured for receiving door 14 when in the closed position as shown in FIGS. 1 and 4. As best seen in FIG. 2, door receiving opening 24 may wrap around a corner of housing 12.

As best seen in FIGS. 1 and 4, door 14 is configured to be selectively positioned in door receiving opening 24 when door 14 is in a closed position. Door 14 may include a first door section 14*a* that is positioned adjacent to a second door section 14*b*, wherein first door portion 14*a* may be disposed at an angle, for example, about 90 degrees, relative to second door section 14*b*. More particularly, door 14 may be L-shaped wherein first and second door portions 14*a*, 14*b* are of similar size and shape. A door corner 34 may be formed at the juncture between first and second door portions 14*a*, 14*b*. Further, the angle formed between first and second sidewall portions 32*a*, 32*b* and the angle formed between first and second door portions 14*a*, 14*b* may be equal so that door 14 properly fits within door receiving opening 24.

As best seen in FIG. 4, first door section 14*a* may include an opening end 36 positioned opposite door corner 34, wherein flange 26*a* extends from opening end 36 and defines an opening edge 40. First door section 14*a* is disposed in a plane 42, and flange 26*a* is angled inwardly toward interior storage space 18 at an angle, for example, about 45 degrees, relative to plane 42 so that first door section 14*a* and flange 26*a* form an obtuse angle. As best seen in FIG. 4, first door section 14*a* and first sidewall portion 32*a* may be coplanar. While flange 26*a* is shown in FIG. 2 as extending along the entire length of opening end 36 of first door section 14*a*, it should be understood that flange 26*a* may extend along a portion of opening end 36.

Figure 3:
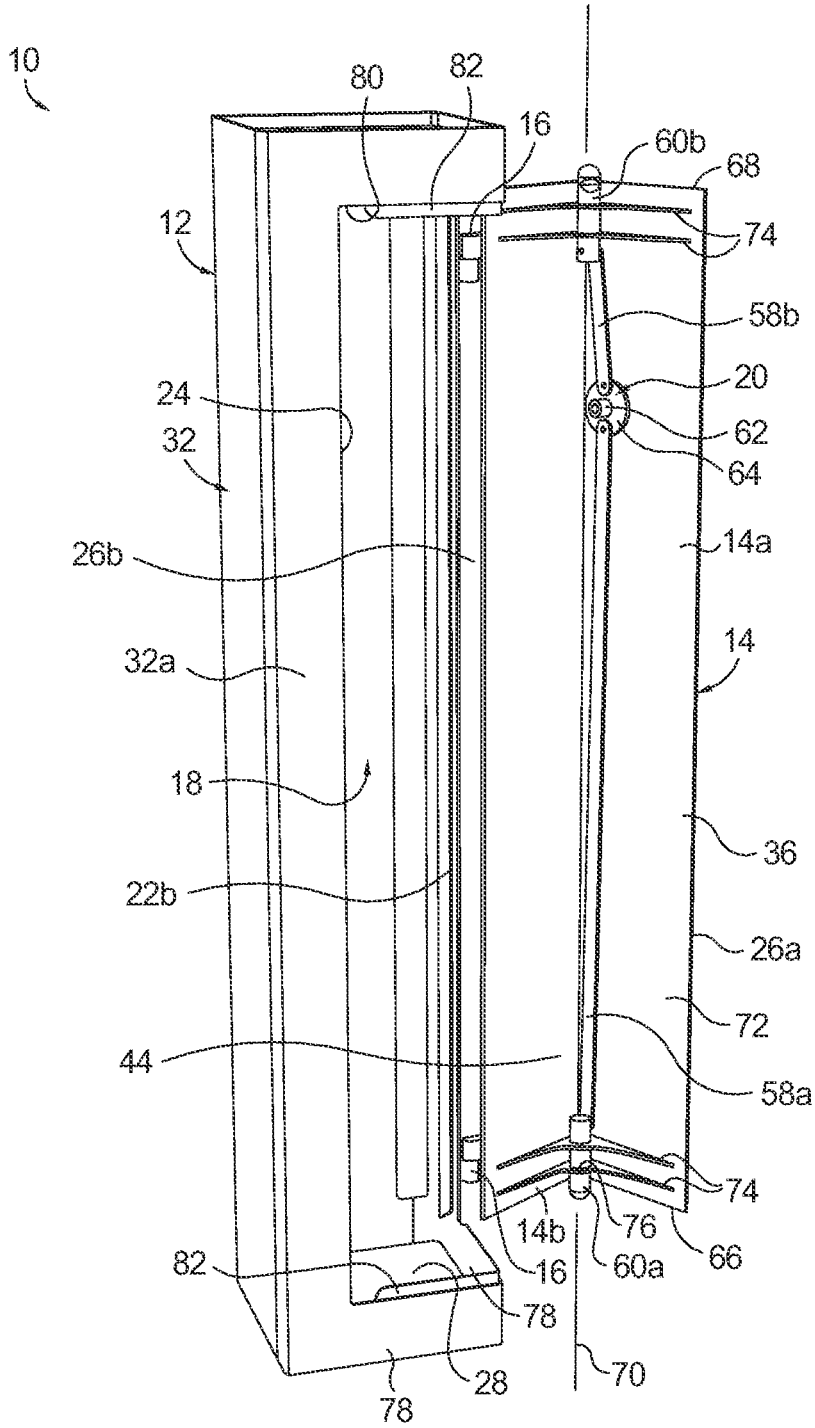
FIG. 3 is another perspective view of the protective enclosure shown in FIG. 2.

As best seen in FIGS. 2-4, second door section 14*b* may include a hinge end 44 positioned opposite door corner 34, wherein flange 26*b* extends from hinge end 44 and defines a hinge edge 48. Second door section 14*b* is disposed in a plane. 50, and flange 26*b* is angled inwardly toward interior storage space 18 at an angle, for example, about 45 degrees, relative to plane 50 so that second door section 14*b* and flange 26*b* form an obtuse angle. As best seen in FIG. 4, second door section 14*b* and second sidewall portion 32*b* may be coplanar. While flange 26*b* is shown in FIG. 1 as extending along the entire length of hinge end 44 of second door section 14*b*, it should be understood that flange 26*b* may extend along a portion of hinge end 44. Further, hinge edge 48 may extend in a direction that is parallel with opening edge 40.

Hinge 16 operates to pivotably coupled door 14 to housing 12 to allow door 14 to be selectively moved between opened and closed positions. As best seen in FIGS. 1, 3 and 4, hinge 16 may be located external to said housing 12, wherein hinge 16 is mounted to an external surface 52 of second sidewall portion 32*b* and an external surface 54 of second door section 14*b*. While protective enclosure 10 uses two hinges 16 to pivotally mount door 14 to housing 12, it should be understood that more or less hinges may be used herein.

Locking mechanism 20 may be mounted to door 14 to selectively secure door 14 to housing 12 to prevent unauthorized access to interior storage space 18. As best seen in FIGS. 1-4, locking mechanism 20 may include a locking handle 56, first and second linkage elements 58*a*, 58*b* operably connected to locking handle 56, and first and second actuating bolts 60*a*, 60*b* connected to first and second linkage elements 58*a*, 58*b*, respectively. Locking handle 56 is accessible by a user outside protective enclosure 10 and includes a shaft 62 that extends through door 14. Shaft 62 is in turn fixedly coupled to a plate 64 positioned in a location that is inaccessible from outside protective enclosure 10 when door 14 is dosed. First linkage 58*a* is connected between plate 64 and first actuating bolt 60*a*, and second linkage 58*b* is connected between plate 64 and second actuating bolt 60*b*. First and second actuating bolts 60*a*, 60*b* are located adjacent to a bottom end 66 and a top end 68 of door 14, respectively, and are movably coupled to door 14 along an axis 70 that is substantially parallel to at least one of opening edge 40 and hinge edge 48. As best seen in FIG. 3, each of first and second actuating bolts 60*a*, 60*b* may be movably mounted to an interior surface 72 of door 14 using a pair of brackets 74. Each of brackets 74 may have a receiving aperture 76 defined therein that is configured for slidably receiving and guiding its respective actuating bolt along axis 70.

When locking handle 56 is rotated in a first direction, linkage 58*a*, 58*b* operates to move first and second actuating bolts 60*a*, 60*b* along axis 70 to an extended locking position to place door 14 in a locked position when door 14 is closed. At least one of first and second sidewall portions 32*a*, 32*b* may include a lower retaining surface 78 that is in a position to engage first actuating bolt 60*a* when in the extended position, and an upper retaining surface 80 that is in a position for engaging second actuating bolt 60*b* when in the extended position to prevent door 14 from being opened when in the locked position. As best seen in FIG. 4, first and second actuating bolts 60*a*, 60*b* may be disposed adjacent to door corner 34 so that first and second sidewall portions 32*a*, 32*b* define upper and lower retaining surfaces 78, 80. Further, as best seen in FIGS. 2 and 3, upper and lower retaining surfaces 78, 80 may include a lip 82 extending from door receiving opening 24 to provide additional surface area for engaging first and second actuating bolts 60*a*, 60*b* when door is in a closed position and locking mechanism 20 is locked.

When locking handle 56 is rotated in a second direction that is opposite of the first direction, linkage 58*a*, 58*b* operates to move first and second actuating bolts 60*a*, 60*b* along axis 70 to a retracted unlocking position to allow door 14 to be opened relative to housing 12 without first and second actuating bolts 60*a*, 60*b* engaging upper and lower retaining surfaces 78, 80 or lip 82.

Housing 12 further includes at least one channel 22*a*, 22*b* disposed along at least a portion of door receiving opening 24. As best seen in FIGS. 2-4, channels 22*a*, 22*b* may be disposed adjacent to door receiving opening 24 in one or more locations that correspond to flanges 26*a*, 26*b* extending from opening end 36 and hinge end 44 of door 14 when door 14 is in the closed position. As best seen in FIG. 4, channels 22*a*, 22*b* may each have a U-shaped configuration. For example, each of channels 22*a*, 22*b* may be formed by using a stepped rail 86 and an inner surface 88*a*, 88*b* of first or second sidewall portions 32*a*, 32*b* of housing 12.

Stepped rail 86 may include a connecting portion 90, an offset leg 92 extending from connecting portion 90, and an extension leg 94 extending from offset leg 92. Each channel 22*a*, 22*b* may be defined by inner surface 88*a*, 88*b* of respective first or second sidewall portions 32*a*, 32*b*, offset leg 92 and extension leg 94, wherein connecting portion 90 may be used to couple stepped rail 86 to inner surface 88*a*, 88*b* of respective first or second sidewall portions 32*a*, 32*b* adjacent to door receiving opening 24. Offset leg 92 may extend inwardly toward interior storage space 18 and in a plane 96*a*, 96*b* that is perpendicular to the respective inner surface 88*a*, 88*b* that stepped rail 86 is mounted to. Specifically, offset leg 92 may extend inwardly a distance 98 that is greater than a distance 100 that flange 26*a*, 26*b* extends inwardly when measured along the respective plane 96*a*, 96*b*. Extension leg 94 may be disposed in a plane 102*a*, 102*b* that is parallel to inner surface 88*a*, 88*b* of the respective sidewall portion 32*a*, 32*b* that stepped rail 86 is mounted to. As best seen in FIG. 4, at least a portion of angled flanges 26*a*, 26*b* are disposed within corresponding channels 22*a*, 22*b* when door 14 is positioned in the closed position.

In operation, interior storage space 18 is accessible when door 14 is in an open position as seen in FIGS. 2 and 3. When door 14 is moved to the closed position as best seen in FIGS. 1 and 4, first flange 26*a* is positioned within channel 22*a*, and second flange 26*b* is positioned within channel 22*b*. Locking mechanism 20 may then be manipulated to secure door 14 to housing 12 by rotating locking handle 56 so that actuating bolts 60*a*, 60*b* are moved to an extended position adjacent to lower and upper retaining surfaces 78, 80 and lip 82 on first and second sidewall portions 32*a*, 32*b*. Therefore, if someone attempts to open door 14 when in the locked position, actuating bolts 60*a*, 60*b* will come into contact with lower and upper retaining surfaces 78, 80 and lip 82 on first and second sidewall portions 32*a*, 32*b* and prevent door 14 from opening.

Protective enclosure 10 effectively resists pry attacks between door 14 and housing 12 due to the combination of channels 22*a*, 22*b* on the door receiving opening 24, and flanges 26*a*, 26*b* extending from opening end 36 and hinge end 44 of door 14 and into channels 22*a*, 22*b*. The combination of channels 22*a*, 22*b* and angled flanges 26*a*, 26*b* create a situation such that inserting a prying tool within either channel 22*a*, 22*b* and applying a force will cause either the outer portion of channel 22*a*, 22*b* (i.e., inner surface 88*a*, 88*b*) to flex, or cause flange 26*a*, 26*b* to flex into extension leg 94 of channel 22*a*, 22*b*, neither of which provide an opening into interior storage space 18 that would allow door 14 to be pried open. Furthermore, in the event that external door hinge 16 is removed during an attack on protective enclosure 10, door 14 cannot be removed from housing 12 because door 14 will simply pivot around the engaged actuating bolts 60*a*, 60*b* about axis 70, with such movement being limited by flanges 26*a*, 26*b* stopping on extension leg 94 of each channel 22*a*, 22*b*. As such, protective enclosure described herein provides for a number of advantages relative to existing protective enclosures.

Although the present invention has been described in considerable detail with reference to certain preferred versions thereof, other versions are possible. Therefore, the spirit and scope of the appended claims should not be limited to the description of the preferred versions contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A protective enclosure comprising:

a housing including a base portion, a top portion and a sidewall extending between said base portion and said top portion, said base portion, said top portion and said sidewall defining an interior storage space, said sidewall including a first sidewall portion and a second sidewall portion, said first sidewall portion is positioned adjacent to said second sidewall portion and disposed at a first angle relative to said second sidewall portion, said first and second sidewall portions defining a door receiving opening;

a door configured for being selectively positioned in said door receiving opening when said door is in a closed position, said door including a first door section and a second door section, said first door section is positioned adjacent to said second door section and disposed at a second angle relative to said second door section, said first door section including an opening end, wherein a first flange extends from said opening end and includes an opening edge, said first flange being angled relative to said first door section inwardly toward said interior storage space so that an internal surface of said first door section and said first flange form an obtuse angle, said second door section including a hinge end, wherein a second flange extends from said hinge end and includes a hinge edge, said second flange being angled relative to said second door section inwardly toward said interior storage space;

a hinge pivotally mounting said second portion of said housing with said second door section; and a locking mechanism including a first actuating bolt and a second actuating bolt, wherein said first and second actuating bolts are movably coupled to said door along an axis that is substantially parallel to at least one of said opening edge and said hinge edge, said first and second actuating bolts being moved to an extended position to place said door in a locked position relative to said housing when door is in said closed position, and said first and second actuating bolts being moved to a retracted position to place said door in an unlocked position relative to said housing, wherein at least one of said first and second sidewall portions includes a first retaining surface configured for engaging said first actuating bolt when in said extended position, wherein at least one of said first and second sidewall portions includes a second retaining surface configured for engaging said second actuating bolt when in said extended position, wherein said housing includes a channel disposed along at least a portion of said door receiving opening defined in said first portion and said second portion of said housing, and wherein at least a portion of said first and second flanges are disposed within said channel when said door is positioned in said closed position relative to said housing.

2. A protective enclosure according to claim 1, wherein said first angle is about 90 degrees.

3. A protective enclosure according to claim 1, wherein said second angle is about 90 degrees.

4. A protective enclosure according to claim 1, wherein said first angle is equal to said second angle.

5. A protective enclosure according to claim 4, wherein said first and second angles are about 90 degrees.

6. A protective enclosure according to claim 1, wherein said second sidewall portion of said housing includes an external surface, wherein said second door section includes an external surface, and wherein said hinge is coupled with said external surface of said second sidewall portion of said housing and said external surface of said second door section.

7. A protective enclosure according to claim 1, wherein said first door section and said second door section are joined together to form a door corner.

8. A protective enclosure according to claim 7, wherein said first and second actuating bolts are movably coupled to said door adjacent to said door corner.

9. A protective enclosure according to Claim 8, wherein said first and second door sections are of equal size and shape.

10. A protective enclosure according to claim 1, wherein said first door section is positioned in a first plane, wherein said first flange is directed inwardly toward said interior storage space at about a 45 degree angle relative to said first plane so that said first door section and said first flange form said obtuse angle.

11. A protective enclosure according to claim 10, wherein said first sidewall portion and said first door section are coplanar.

12. A protective enclosure according to claim 10, wherein said second door section is positioned in a second plane that is perpendicular to said first plane, wherein said second flange is directed inwardly toward said interior storage space at about a 45 degree angle relative to said second plane so that said second door section and said second flange form an obtuse angle.

13. A protective enclosure according to claim 12, wherein said second sidewall portion and said second door section are coplanar.

14. A protective enclosure according to claim 1, wherein said opening edge is parallel with said hinge edge.

15. A protective enclosure according to claim 1, wherein said first flange is angled inwardly toward said interior storage space along the entire length of said opening end.

16. A protective enclosure according to claim 1, wherein said second flange is angled inwardly toward said interior storage space along the entire length of said hinge end.

17. A protective enclosure according to claim 1, wherein said channel is a U-shaped channel.

18. A protective enclosure according to claim 17, further comprising a stepped rail coupled to an inner surface of said housing, said stepped rail including an offset portion and an extension portion, wherein said U-shaped channel is defined by said inner surface of said housing adjacent to said door receiving opening, said offset portion, and said extension portion.

19. A protective enclosure according to claim 18, wherein said extension portion is disposed in a plane that is parallel to said inner surface of said housing adjacent to said door receiving opening.

20. A protective enclosure according to claim 18, wherein said offset portion extends inwardly toward said interior storage space and in a direction that is perpendicular to said inner surface of said housing adjacent to said door receiving opening.

21. A protective enclosure according to claim 18, wherein stepped rail further includes a connecting portion that is coupled with said inner surface of said housing adjacent to said door receiving opening.

22. A protective enclosure according to claim 1, further comprising a pair of brackets mounted to an inner surface of at least one of said first and second door sections, each of said brackets having a receiving aperture defined therein that is configured for slidably receiving and guiding one of said first and second actuating bolts along said axis.

23. A protective enclosure according to claim 1, further comprising a lip extending from at least one of said upper and lower retaining surfaces into said door receiving opening.

24. A protective enclosure comprising:

a housing including a base portion, a top portion and a sidewall extending between said base portion and said top portion, said base portion, said top portion and said sidewall defining an interior storage space, said sidewall including a first sidewall portion and a second sidewall portion, said first sidewall portion is positioned adjacent to said second sidewall portion and disposed at a 90 degree angle relative to said second sidewall portion, said first and second sidewall portions defining a door receiving opening, said second sidewall portion including an external surface;

a door configured for being selectively positioned in said door receiving opening when said door is in a closed position, said door including a first door section and a second door section, said first door section is positioned adjacent to said second door section to form a door corner and disposed at a 90 degree angle relative to said second door section, said first door section is positioned in a first plane and includes an opening end, wherein a first flange extends from said opening end and includes an opening edge, said first flange being angled relative to said first door section inwardly toward said interior storage space at about a 45 degree angle relative to said first plane so that an internal surface of said first door section and said first flange form an obtuse angle, said first sidewall portion and said first door section are coplanar, said second door section is positioned in a second plane that is perpendicular to said first plane and includes a hinge end and an external surface, wherein a second flange extends from said hinge end and includes a hinge edge that is parallel with said opening edge, said second flange being angled relative to said second door section inwardly toward said interior storage space at about a 45 degree angle relative to said second plane so that said second door section and said second flange form an obtuse angle, said second sidewall portion and said second door section are coplanar;

a hinge pivotally mounting said second portion of said housing with said second door section, said hinge being coupled with said external surface of said second sidewall portion of said housing and said external surface of said second door section; and a locking mechanism including a first actuating bolt and a second actuating bolt, wherein said first and second actuating bolts are movably coupled to said door adjacent to said door corner along an axis that is substantially parallel to at least one of said opening edge and said hinge edge, said first and second actuating bolts being moved to an extended position to place said door in a locked position relative to said housing when door is in said closed position, and said first and second actuating bolts being moved to a retracted position to place said door in an unlocked position relative to said housing, wherein at least one of said first and second sidewall portions includes a first retaining surface configured for engaging said first actuating bolt when in said extended position, wherein at least one of said first and second sidewall portions includes a second retaining surface configured for engaging said second actuating bolt when in said extended position, wherein said housing includes a U-shaped channel disposed along at least a portion of said door receiving opening defined in said first portion and said second portion of said housing, and wherein at least a portion of said first and second flanges are disposed within said U-shaped channel when said door is positioned in said closed position relative to said housing.

25. A protective enclosure comprising:

a housing defining a door receiving opening for providing access to an interior storage space;

a door configured for being selectively positioned in said door receiving opening when said door is in a closed position, said door including an opening end and a hinge end, wherein a first flange extends from said opening end and is angled relative to an internal surface of said door inwardly toward said interior storage space, said first flange and said internal surface of said door forming an obtuse angle, and wherein a second flange extends from said hinge end and is angled relative to said surface of said door inwardly toward said interior storage space, said second flange and said internal surface of said door forming an obtuse angle;

a hinge pivotally mounting said housing with said hinge end of said door; and a locking mechanism coupled with said door for selectively locking said door to said housing when said door is in said closed position, wherein said housing includes a channel disposed along at least a portion of said door receiving opening, and wherein at least a portion of said first and second flanges are disposed within said channel when said door is positioned in said closed position relative to said housing.

* * * * *